US006119464A

United States Patent [19]

Nakayama et al.

[11] Patent Number: 6,119,464

[45] Date of Patent: Sep. 19, 2000

[54] BEVERAGE SERVERS AND THEIR CONTROLLING METHODS

[75] Inventors: Hiroshi Nakayama; Takaaki Furuhashi; Katsuoki Kawanishi, all of Kawaguchi; Kenji Kobayashi, Muroran; Takashi Mizumoto, Muroran; Kazumasa Masuda, Muroran; Yasuo Fujikura, Yokohama, all of Japan

[73] Assignees: Sapporo Breweries Limited, Tokyo; Nittetsu Hokkaido Control Systems Co., Muroran; Tokyo Cooling Technical Co., Ltd., Yokohama, all of Japan

[21] Appl. No.: 08/756,916

[22] Filed: Dec. 2, 1996

[30] Foreign Application Priority Data

Nov. 30, 1995 [JP] Japan ..... 7-312750

[51] Int. Cl.[7] ..... F25C 1/00

[52] U.S. Cl. ..... 62/59; 62/139

[58] Field of Search ..... 62/3.64, 59, 139, 62/138

[56] References Cited

U.S. PATENT DOCUMENTS

| | | | |
|---|---|---|---|
| 4,754,609 | 7/1988 | Black | 62/59 |
| 4,939,908 | 7/1990 | Ewing et al. | 62/139 |
| 5,367,879 | 11/1994 | Doke et al. | 62/3.64 |
| 5,474,717 | 12/1995 | Bucher et al. | 62/59 |
| 5,544,489 | 8/1996 | Moren | 62/3.64 |
| 5,627,310 | 5/1997 | Johnson | 62/59 |

FOREIGN PATENT DOCUMENTS

| | | |
|---|---|---|
| 8-178470 | 7/1996 | Japan . |
| 9-42815 | 2/1997 | Japan . |

*Primary Examiner*—William E. Tapolcai
*Attorney, Agent, or Firm*—Oblon, Spivak, McClelland, Maier & Neustadt, P.C.

[57] ABSTRACT

A beverage server comprises a tank containing water serving as a coolant and a coiled beverage duct through which beer or other beverage flows and cooling means fitted to a portion of the wall of the tank so as to rapidly cool and serve beer or other beverage discharged from the storage container. The inner wall of the tank near the portion where the cooling means is fitted is made of a material having a high thermal conductivity, whereas the inner wall of the tank near the beverage duct is made of a material having a low thermal conductivity. A sensor is provided near the beverage duct to obtain information for controlling the cooling means. This simple beverage server assures stable serving of beverage at a suitable temperature. Another sensor is provided near a portion of the tank wall where the cooling means and a controller to controls the action of the cooling means based on the information from the sensors are also provided. The cooling means works at full capacity when one or both of the sensors have detected the melting of the coolant. This eliminates the risk of trouble due to cooling capacity deficiency even after a long interruption of cooling.

10 Claims, 9 Drawing Sheets

BEVERAGE SERVERS AND THEIR CONTROLLING METHODS

FIELD OF THE INVENTION

This invention relates to beverage servers that rapidly cool and serve beverages discharged from the storage container and methods for controlling such beverage servers.

BACKGROUND OF THE INVENTION

Convention al beverage servers in popular use have a refrigerating coil and a beverage cooling coil in a tank. The refrigerating coil makes ice and the cooling coil cools a beverage passed therethrough. A sensor is provided near the cooling coil to control the cooling temperature by controlling the rate of ice production.

For example, beer or other beverage in a barrel 37 has conventionally been served through a cock 7 into a mug or other cup after rapidly cooling from room temperature to a suitable temperature by passing through an instantaneously cooling server 33 as shown in FIG. 12. Pressure is applied on the surface of the beverage by supplying carbon dioxide gas from a carbon dioxide cylinder 34 connected to the barrel 37 through a pressure-regulating valve 35 that regulates the pressure of the carbon dioxide gas, a gas hose 36 and a fitting 39. The beverage under pressure is then sent through a down tube 38, the fitting 39 and a beverage hose 40 to a coiled beverage duct 4 in the tank 1 filled with a coolant and placed in the cooling server 33. The cooled beverage flows out when the cock 7 is opened . Reference numerals 5 and 6 designate an inlet and an outlet, respectively.

FIG. 13 shows an example of a conventional instantaneously cooling server 33 that comprises a coiled beverage duct 4 placed in a tank 1. An ice-making coil 41 cools water serving as a coolant to cool the beverage in the coiled duct 4. The ice-making coil 41 makes ice therearound during the night or other times when the server is not in use. A sensor 13 is provided to control the production of ice 12 so that the beverage in the coiled duct 4 remains unfrozen and served at a suitable temperature. Reference numerals 17, 42, 43 and 44 designate a stirrer to stir the water in the tank 1, a cooling fan, a condenser and a cooler to supply a coolant to the ice-making coil 41.

Recently cooling and refrigerating devices using electronic elements instead of fluorocarbon are finding increasing use. This technology utilizes the Peltier effect that heat other than Joule's heat is evolved and absorbed at the junction of two dissimilar conductors or semiconductors through which direct current is passed and absorption changes to evolution and vice versa when the direction of the current is reversed. The inventors developed a beverage server that cools the coolant in a tank 1 by means of a cooling unit using an electronic cooling element that is fitted to the outside of the wall of the tank 1 of the server of the type shown in FIG. 12, as proposed in Japanese Provisional Patent Publication No. 178470 of 1996.

FIG. 14 shows an example of the cooling unit just described. An electronic cooling element 8 is placed in contact with a surface (the element is attached to the bottom in the illustrated example) of a tank 1, with heat-transfer plates 31 and a heat-transfer spacer 32 placed therebetween. By the endothermic action of the Peltier effect, the cooling element 8 cools water 11, forms ice 12 in the tank 1 and cools the beverage flowing through a coiled beverage duct 4. This unit also has a sensor 13 disposed near the beverage duct 4 to control the cooling temperature by varying the current passed to the electronic cooling element 8 so that the ice is made near the duct 4 but kept out of contact therewith.

In FIG. 14, multiple electronic cooling elements 8 are provided, with heat-insulating materials 30 disposed between the individual elements. A fan 10 releases the heat absorbed by the elements 8 to the outside through a heat-release fin 9. The tank 1 is covered with a heat-insulating material 29 and an outer panel 28. Reference numerals 17 and 18 designate a water stirrer and a heat-exchange rod disposed in the coiled beverage duct 4 to make the ice 12. An electrode that becomes non-conductive when ice is formed or a temperature sensor that measures the temperature of ice is used as the sensor 13 in this server and one equipped with a refrigerating coil as described earlier.

FIGS. 15 and 16 show an example of a beverage server in which the tank 1 is cooled by an electronic cooling element attached to the side thereof. FIG. 15 is a vertical cross-sectional view and FIG. 16 is a horizontal cross-section seen in the direction of the arrow A in FIG. 15. An electronic cooling element 8 fitted to the side wall of the tank I cools water 11 that serves as a cool ant in the tank 1 and a heat-release fin 9 and a fan 10 release the generated heat. A coiled beverage duct 4 is provided in the tank 1. Beer or other beverage is supplied from an inlet 5 under pressure, cooled to a suitable temperature, and poured into a mug or other drinking cup through an outlet 6 when a pouring cock 7 is opened.

Part of the water 11 is made into ice 12 as the water 11 serving as a coolant in the tank 1 must be constantly kept cooled so that the beverage is always cooled to a suitable temperature even when served continuously. The ice 12 is formed in an area near the coiled beverage duct 4 that neither is in contact with nor extends to the inside of the coil. Thus, the beverage in the coiled duct 4 is served at a suitable temperature, i.e., between 2° C. and 8° C. in the case of beer, without freezing.

The contour of the ice-making zone is controlled by means of a sensor 13 placed near the beverage duct 4 and a stirrer 17 provided in the coiled duct 4 to cause the water to move therein. The sensor, such an electrode that becomes non-conductive when the ice 12 comes into contact therewith or other ordinary temperature sensor, controls the current passed to the electron cooling element 8 by sensing the boundary between the ice and water. The sensor also controls so that the beverage in the coiled duct 4 does not become over-cooled when, for example, serving is stopped.

The contour of the ice-making zone varies with the place where the sensor 13 is provided or where data for ice production control is collected. If the sensor 13 is placed on the outside of the coiled beverage duct 4 and substantially in the center of the tank 1 as shown in FIGS. 15 and 16, ice may be formed on the inside of the coiled duct as illustrated when the beverage is not poured. The ice of the illustrated shape may freeze the beverage in the coiled duct 4 or vary the temperature at which the beverage is served. An ideally shaped ice-making zone may be obtained if more elaborate control is applied by installing many sensors 13. However, complex structure and substantial cost increase are inevitable.

In the conventional beverage servers of the above-described type as shown in FIG. 13 that have an ice-making refrigerating coil in the water tank, ice 12 does not melt from the side in contact with the refrigerating coil 41 even when cooling is stopped. In the beverage servers that make ice by employing the wall of the water tank as the cooling surface as shown in FIG. 14 and FIG. 15, however, heat from the outside melts ice earlier on the cooling surface side than on the coiled beverage duct 4 side when cooling at the tank wall is stopped.

With this type of beverage servers, therefore, a deficiency of beverage cooling capacity due to ice shortage may occur after a long interruption of operation during the night or other times. On such occasions, melting may advance from the cooling surface side to, in extreme cases, a point close to the beverage cooling coil, with the sensor near the beverage cooling coil continuing to indicate that ice is present.

In the beverage server proposed in Japanese Provisional Patent Publication No. 178470 of 1996, for example, water in the tank 1 whose bottom serves as the cooling surface is cooled by the endothermic action of the electronic cooling elements 8 through the heat-transfer spacer 32 and the heat-transfer plates 31, as shown in FIG. 14. Therefore, no heat insulator is used in this cooling surface. If the sensor 13 detects the presence of ice and current supply to the electronic cooling element 8 is cut off, heat may flow into the tank through the heat-transfer plates 31 and the heat-transfer spacer 32 and, as a consequence, melting from the cooling surface side will proceed.

If cooling operation is continued without interruption to prevent the melting of ice in this type of beverage servers that employ the wall of the water tank as the cooling surface, ice will grow to the beverage cooling coil and freezes the beverage contained therein. This over-cooling can be prevented by applying a closer temperature control by detecting the water temperature distribution in the tank using many temperature sensors. However, this solution inevitably increases the cost of the server.

SUMMARY OF THE INVENTION

An object of this invention is to provide a beverage server that rapidly cools beer or other beverages by employing the wall of the water tank therein as the cooling surface and serves them at a suitable temperature and form ing an ideally shaped ice-making zone in the tank containing the beverage duct without complicating the structure of the server and a method for controlling such a server.

Another object of this invention is to provide a beverage server having a simple ice growth control system that efficiently controls the production of ice to a desired area while preventing the melting of ice from the cooling surface side that might be caused by the penetration of heat from the cooling surface side after stopping ice making and a method for controlling such a beverage server.

To achieve the above objects, a beverage server according to this invention comprises a tank to hold water serving as a coolant, a coiled beverage duct through which beverage flows, and a cooling device provided on the outer wall of the tank. A portion of the inner wall of the tank made of a material having a high thermal conductivity that is situated in and around the place where the cooling means is fitted constitute a cooling zone. A portion of the inner wall of the tank made of a material having a low thermal conductivity that is situated near the beverage duct constitutes a controlled cooling zone. A sensor to sense the freezing and melting of the coolant is provided near the beverage duct. A controller to maintain the ice-making zone in a desired region by controlling the action of the cooling device based on the information supplied from the sensor is also provided.

Another beverage server according to this invention also comprises a tank to hold water serving as a coolant, a coiled beverage duct through which beverage flows, and a cooling device provided on the outer wall of the tank. Sensors to sense the freezing and melting of the coolant are provided near the inside of the tank wall on which the cooling device is provided and near the beverage duct. A controller to maintain the ice-making zone in a desired region by controlling the action of the cooling device based on the information supplied from the sensors is also provided.

Preferably, a portion of the inner wall of the tank made of a material having a high thermal conductivity that is situated in and around the place where the cooling device is fitted constitutes a cooling zone. A portion of the inner wall of the tank made of a material having a low thermal conductivity that is situated near the beverage duct constitutes a controlled cooling zone.

A beverage server controlling method according to this invention controls a beverage server comprising a tank to hold water serving as a coolant, a coiled beverage duct through which beverage flows, and a cooling device provided on the outer wall of the tank, with sensors to sense the freezing and melting of the coolant provided near the inside of the tank wall on which the cooling device is provided and near the beverage duct and a controller to maintain the ice-making zone in a desired region by controlling the action of the cooling device based on the information supplied from the sensors also provided. The controlling method comprises the steps of freezing the coolant within a desired zone by cooling the coolant by the cooling device, stopping or moderating the cooling action thereof, and then resuming the freezing of the coolant thereby.

Another beverage server controlling method according to this invention controls a beverage server comprising a tank to hold water serving as a coolant, a coiled beverage duct through which beverage flows, and a cooling device provided on the outer wall of the tank, with sensors to sense changes in the condition of the coolant provided near the inside of the tank wall on which the cooling device is provided and near the beverage duct. The controlling method comprises the steps of freezing the coolant within a desired zone by cooling the coolant by the cooling device, stopping or moderating the cooling action thereof, and then resuming the freezing of the coolant thereby when either one or both of the sensors provided in two places have sensed the melting of the coolant.

BRIEF DESCRIPTION OF THE INVENTION

DETAILED DESCRIPTION OF THE INVENTION

Figure 1:
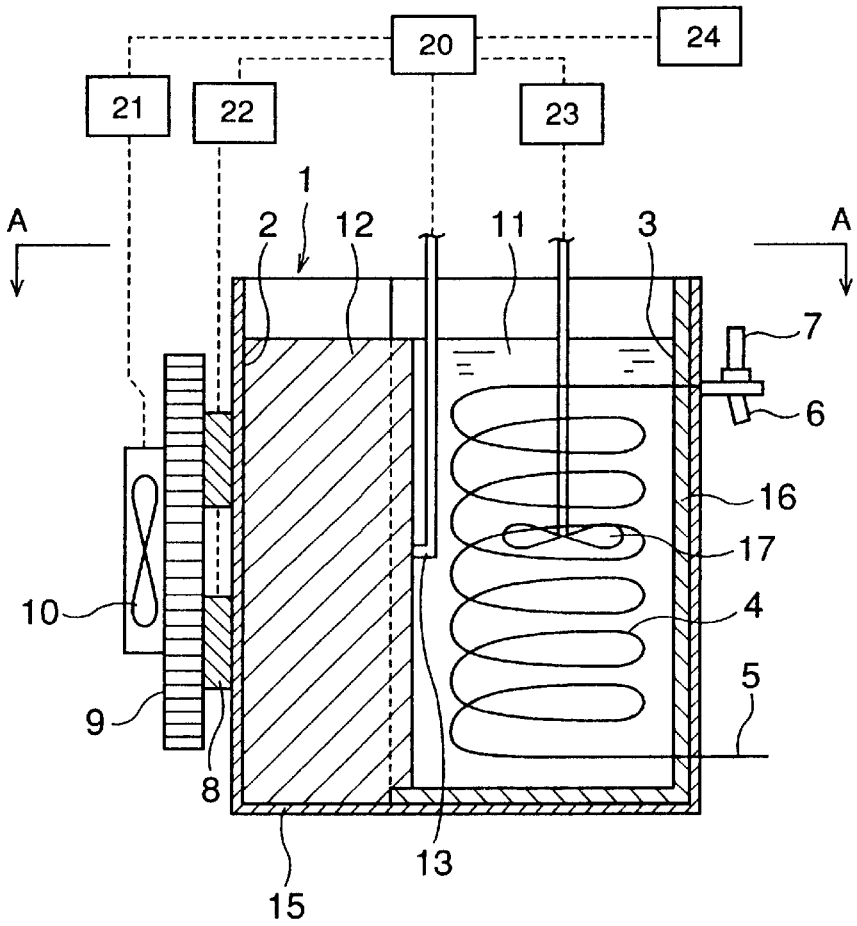
FIG. 1 is a vertical cross-sectional view of an embodiment of this invention.
Figure 2:
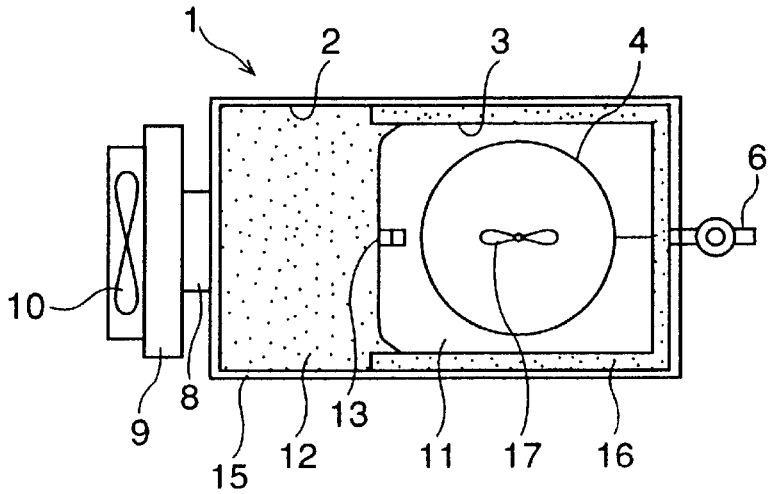
FIG. 2 is a top view of the same embodiment seen in the direction of the arrow A—A in FIG. 1.

Specific examples of this invention are described in the following. FIGS. 1 and 2 show an embodiment of this invention. A tank 1 contains water 11 serving as a coolant and a coiled beverage duct 4 through which beverage flows. An electronic cooling element 8 serving as a cooling device is fitted to one of the walls of the tank 1. The electronic cooling element 8 fed with direct current from a power supply not shown cools the water in the tank 1 by absorbing heat by means of the Peltier effect. The absorbed heat is released by a heat-release fin 9 and a fan 10. Beer or other beverage fed under pressure into the coiled beverage duct 4 in the tank 1 through an inlet 5 is cooled by the water 11 and poured into a mug or other container through an outlet 6 by opening a cock 7.

A portion of the inner wall of the tank made of metal sheet 15 or other material having a high thermal conductivity and situated in and around the place where the electronic cooling element 8 is fitted constitutes a cooling zone 2. A portion of the inner wall made of plastic sheet 16 or other material having a low thermal conductivity and situated near the beverage duct 4 constitutes a controlled cooling zone 3 . Thus, ice 12 is made in an area contacting the cooling zone 2, whereas ice-making is suppressed in the controlled cooling zone 3. A sensor 13 to detect the freezing and melting of the coolant is provided near the periphery of the coiled beverage duct 4. A controller 20 maintains the ice-making zone within a desired region by controlling the action of the cooling device based on the information from the sensor 13. By this means, an ideally shaped ice-making zone is obtained near, but not in contact with, the beverage duct 4.

In this embodiment, the information from the sensor 13 is input in the controller 20 that controls the amount of electric power supplied from a cooling element power supply 22 to the electronic cooling element 8, thereby maintaining the ice-making zone within a desired region. Power supplies from a fan drive power supply 21 to the fan 10 and from a stirrer drive power supply 23 to a stirrer 17 can be controlled, too. Control conditions can be adjusted as well by measuring the temperature of the water 11. Reference numeral 24 denotes a main power supply that supplies electric power to the controller 20 and power supplies 21, 22 and 23. The controlled cooling zone 3 is provided by inserting the plastic sheet 16 in a portion of the tank 1 made of the metal sheet 15.

The stirrer 17 disposed in the coiled beverage duct causes the water 11 to move along the inside and outside thereof. This motion, in conjunction with the action of the sensor 13, prevents the ice 12 from coming into contact with the coiled beverage duct. An electrode that becomes non-conductive when it comes into contact with the ice 12 or other common type of sensor may be used as the sensor 13.

A propeller of the illustrated type or a pump may be used as the stirrer 17. In this embodiment, the controlled cooling zone 3 is provided by inserting the plastic sheet 16 in a portion of the tank 1 made of the metal sheet 15.

Table 1 gives examples of the materials having a high and a low thermal conductivity used for the cooling zone 2 and the controlled cooling zone 3, respectively. Table 1 shows the thermal conductivity of each material. The tank 1 is insulated by being covered with sponge rubber, urethane or other insulator not shown. In addition to the electronic cooling element 8, other conventional cooling medium may be used by burying a coolant duct in the wall of the cooling zone 2 made of a material having a high thermal conductivity.

An ideally shaped ice-making zone can be obtained near, but not in contact with, the beverage duct of the instantaneously cooling beverage server of this invention. The instantaneously cooling beverage server of this invention has a relatively simple structure and stably serves beverage at a suitable temperature without requiring any complex control that is often required by the conventional servers.

TABLE 1

| Material | Thermal Conductivity [W/(m · K)] |
|---|---|
| Cooling Zone | |
| Aluminum | 237 |
| Copper | 398 |
| Steel | 80.3 |
| Titanium | 21.9 |
| Stainless steel | 16.0 |
| Controlled Cooling Zone | |
| Polyurethane rubber | 0.12~0.18 |
| Silicon resin | 0.15~1.17 |
| Bakelite | 0.33~0.67 |
| Lauan (wood) | 0.085 |
| Polyvinyl chloride (PVC) | 0.13~0.29 |
| Polyethylene (PE) | 0.33 |
| Polypropylene (PP) | 0.13 |
| For Reference | |
| Transparent water | 2.2 |

Figure 3:
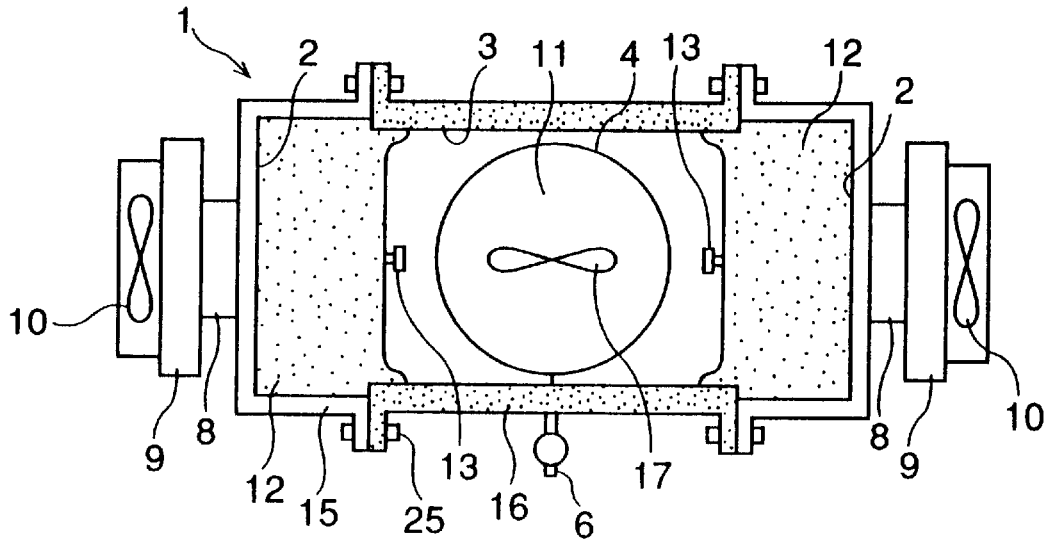
FIG. 3 is a top view of another embodiment of this invention.

Another embodiment of this invention is described below. FIG. 3 is a top view showing a rectangular parallelepiped tank 1. This embodiment has electronic cooling elements 8 on two side walls of the tank 1 and two cooling zones 2 formed by the same side walls and part of the remaining two side walls on both sides of a beverage duct 4. Metal sheets 15 forming the cooling zones 3 and plastic sheets 16 forming a controlled cooling zone 2 are joined together with bolts and nuts 25. Making ice on both sides of the beverage duct 4, this embodiment has a high beverage cooling capacity and, thus, is capable of serving a large quantity of beverage. Two different kinds of beverages may be served if the beverage duct 4 is double-coiled.

Figure 4:
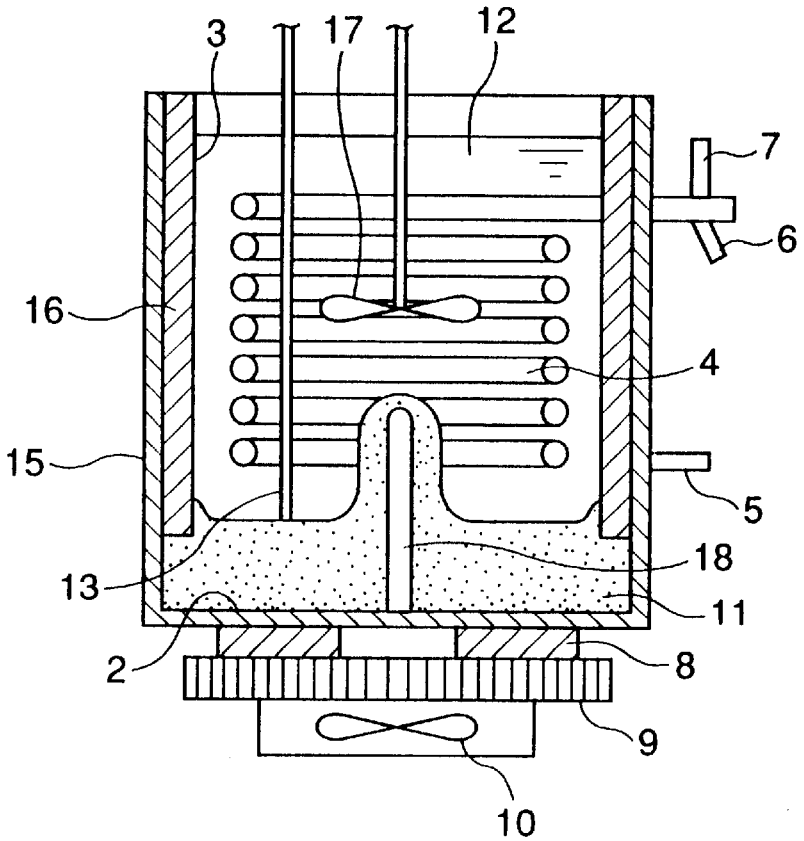
FIG. 4 is a vertical cross-sectional view of a still another embodiment of this invention.

FIG. 4 is a vertical cross-sectional view of a cylindrical tank 1. This embodiment has an electronic cooling element 8 under the bottom of the tank 1, with the bottom and part of the side of the tank 1 forming a cooling zone 2. A heat-exchange rod 18 extends from the cooling zone in the bottom to the inside of a coiled beverage duct 4. The heat-exchange rod 18 is made of a material selected from the group having a high thermal conductivity given in Table 1. A plastic sheet 16 forming a controlled cooling zone 3 is fitted in the side wall of the tank 1 of a metal sheet 15, as illustrated.

Forming ice below the coiled beverage duct 4 and on the inside of the lower part thereof, the embodiment shown in FIG. 4 has a high beverage cooling capacity and a large beverage serving capacity.

As with the embodiments shown in FIGS. 1 and 2, the tank 1 of the embodiments shown in FIGS. 3 and 4 may also be made of the materials given in Table 1. The tank is covered with an insulating material, whereas the cooling device of the types described earlier may be used. A controller 20 controls the cooling condition based on the information from a sensor 13.

Figure 5:
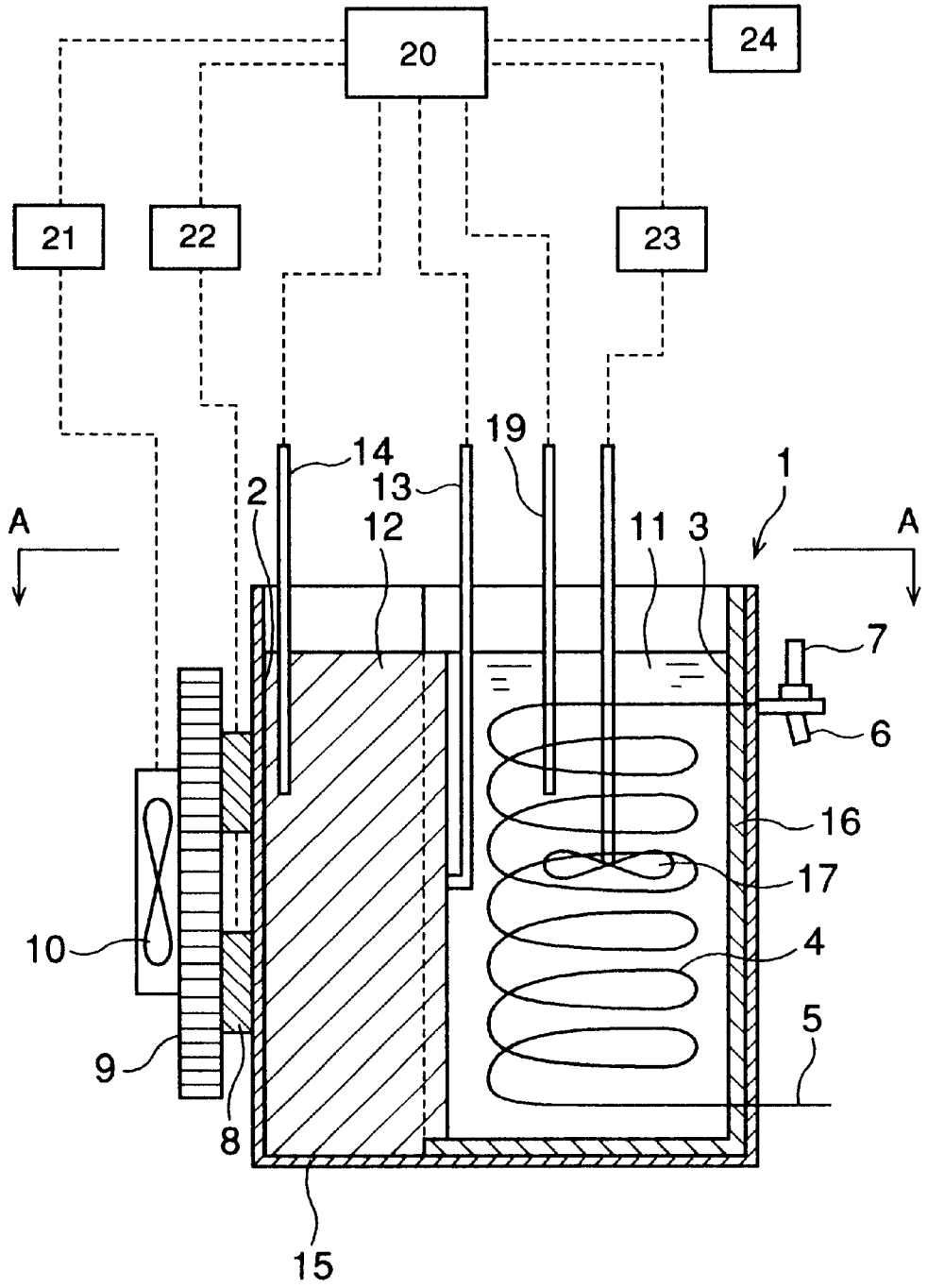
FIG. 5 is a vertical cross-sectional view of yet another embodiment of this invention.
Figure 6:
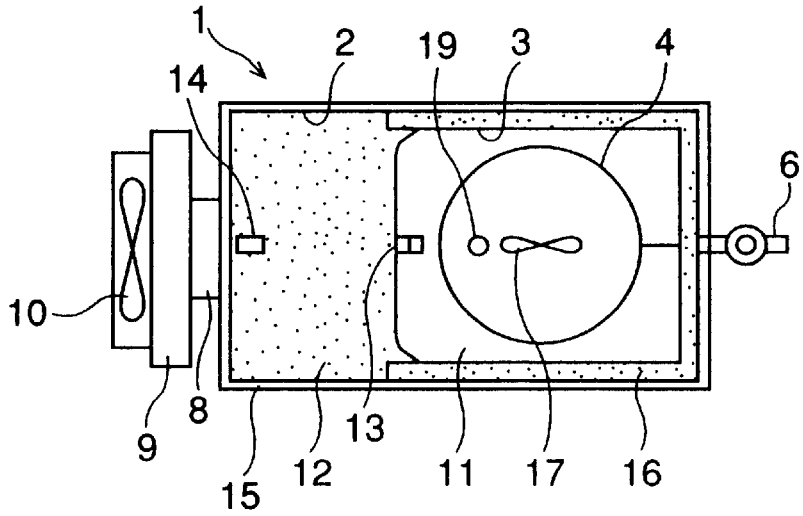
FIG. 6 is a top view of the same embodiment seen in the direction of the arrow A—A in FIG. 5.

Still another embodiment of this invention is described below. FIG. 5 is a vertical cross-sectional view of still another embodiment of this invention and FIG. 6 is a top view of the same embodiment seen in the direction of the arrow A—A in FIG. S. A tank 1 contains water 11 serving as a coolant and a coiled beverage duct 4 through which beverage flows. An electronic cooling element 8 is fitted to one of the side walls of the tank 1. With direct current supplied from a cooling element power supply 22, the electronic cooling element 8 cools the water 11 in the tank 1 and makes ice 12 by absorbing heat by means of the Peltier effect. A heat-release fin 9 and a fan 10 release the absorbed heat to the outside. Beer or other beverage is supplied under pressure to the coiled beverage duct 4 from an inlet 5, cooled to a suitable temperature by the water 11, and poured into a mug or other drinking cup through an outlet 6 when a pouring cock 7 is opened.

The beverage server of this invention having a cooling device on some part of the side walls of the tank 1 also has a sensor that detects the freezing and melting of the water 11 serving as a coolant in the vicinity of the inside of the wall of the tank where the cooling device is provided and in the vicinity of the beverage duct. A controller 20 keeps the ice-making zone within a desired area by controlling the cooling device based on the information from the sensor. To detect the freezing and melting of the coolant, the embodiment shown in FIGS. 5 and 6 has a sensor 13 near the beverage duct 4 and another sensor 14 near the inside of the wall of the tank 1 where the electronic cooling element 8 is fitted.

As illustrated in FIG. 5, the controller 20 keeps the zone where the ice 12 is made within a desired area by controlling the current supplied from a cooling element power supply 22 to the electronic cooling element 8 based on the information from the sensors 13 and 14. The controller 20 is also capable of controlling the current supplied from a fan drive power supply 21 to a fan 10 and from a stirrer drive power supply 23 to a stirrer 17. The control conditions may be adjusted by means of a thermometer that measures the temperature of the water 11. Reference numeral 24 designates main power supply that supplies electric power to the controller 20 and the power supplies 21, 22 and 23.

The zone in which the ice 12 is made is provided near, but not in contact with, the beverage duct 4 by controlling the current supplied to the electronic cooling element 8 by means of the controller 20 when the sensor 13 has detected the freezing of the water 11. After the electronic cooling element 8 has stopped cooling, the advance of melting can be prevented by controlling the current supplied to the electronic cooling element 8 by means of the controller 20 when the sensor near the inside of the wall of the tank 1 where the element 8 is fitted has detected the melting of the ice 12. The stirrer 17 disposed in the coiled beverage duct 4 causes the water 11 to flow along the inside and outside thereof, thereby preventing the ice 12 from coming into contact with the coiled beverage duct, in conjunction with the sensor 13. An electrode that becomes non-conductive when it comes into contact with the ice 12 or other common type of sensor may be used as the sensor 13. A propeller of the illustrated type or a pump may be used as the stirrer 17.

In the preferred embodiment shown in FIGS. 5 and 6, a portion of the inner wall of the tank 1 made of a metal sheet 15 or other material having a high thermal conductivity and situated in and around the place where the electronic cooling element 8 is fitted constitutes a cooling zone 2. The inner wall in the vicinity of the beverage duct 4 made of a plastic sheet 16 or other material having a low thermal conductivity constitutes a controlled cooling zone 3 . Therefore, the ice 12 is made in an area in contact with the cooling zone 2, whereas ice-making is suppressed in the controlled cooling zone 3. Still, the sensor 13 disposed near the outer periphery of the coiled beverage duct 4 permits controlling the contour of an area where the ice 12 is formed to an ideal shape near, but not in contact with, the coiled beverage duct 4. In this embodiment, the controlled cooling zone 3 is formed by the plastic sheet 16 that is inserted in a portion of the tank 1 of the metal sheet 15.

The materials having a high and a low thermal conductivity used for the cooling and the controlled cooling zones may be selected from the group given in Table 1. The tank 1 is insulated by being covered with sponge rubber, urethane or other insulator not shown. In addition to the electronic cooling element 8, other conventional cooling medium may be used by burying a coolant duct in the wall of the cooling zone 2 made of a material having a high thermal conductivity.

Figure 7:
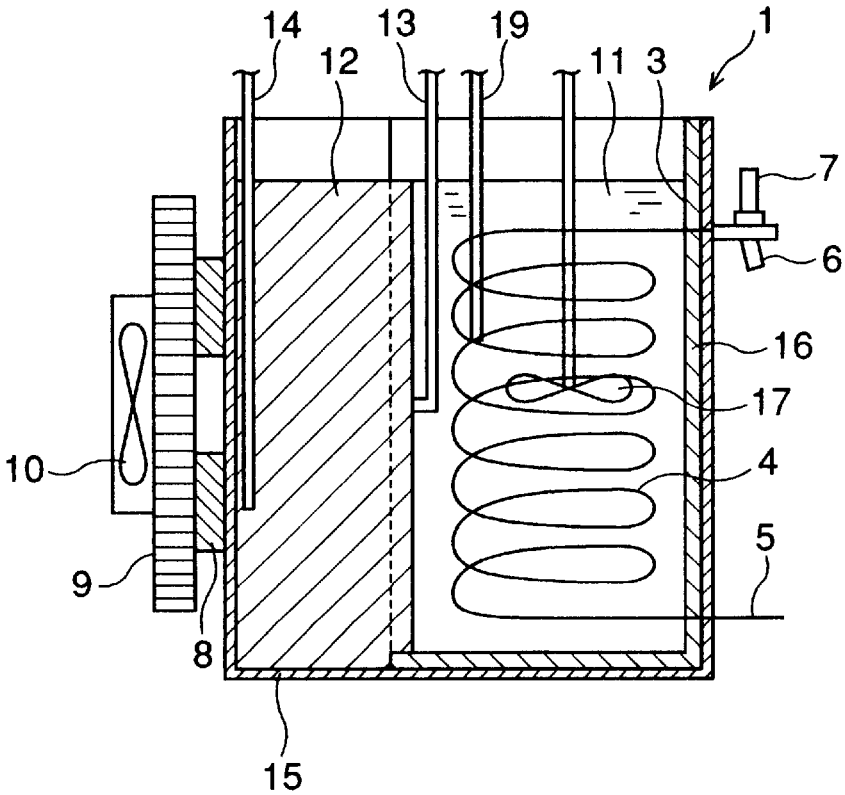
FIG. 7 is a vertical cross-sectional view of a further embodiment of this invention.
Figure 8:
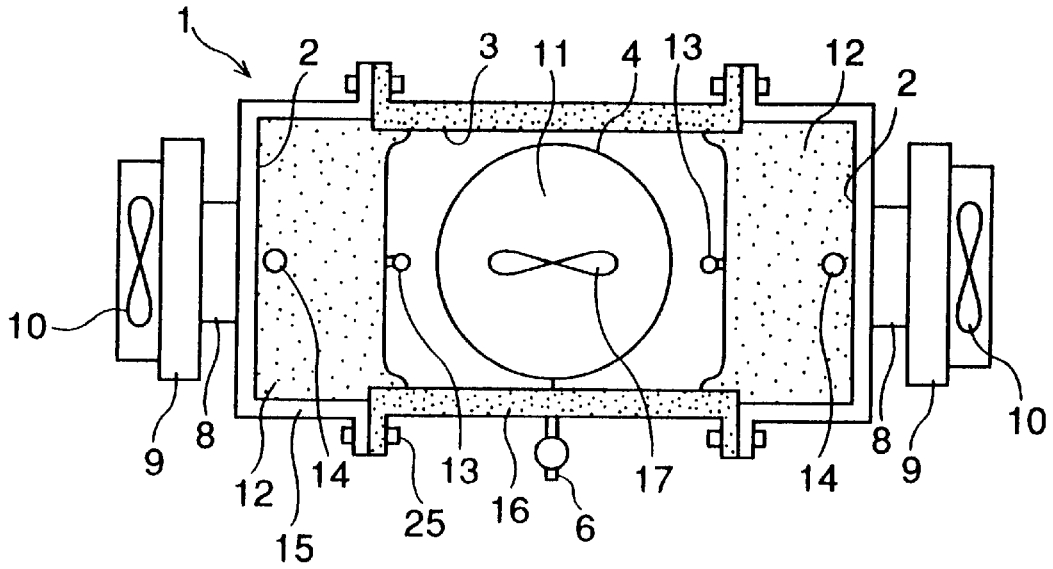
FIG. 8 is a horizontal cross-sectional view of another embodiment of this invention.
Figure 9:
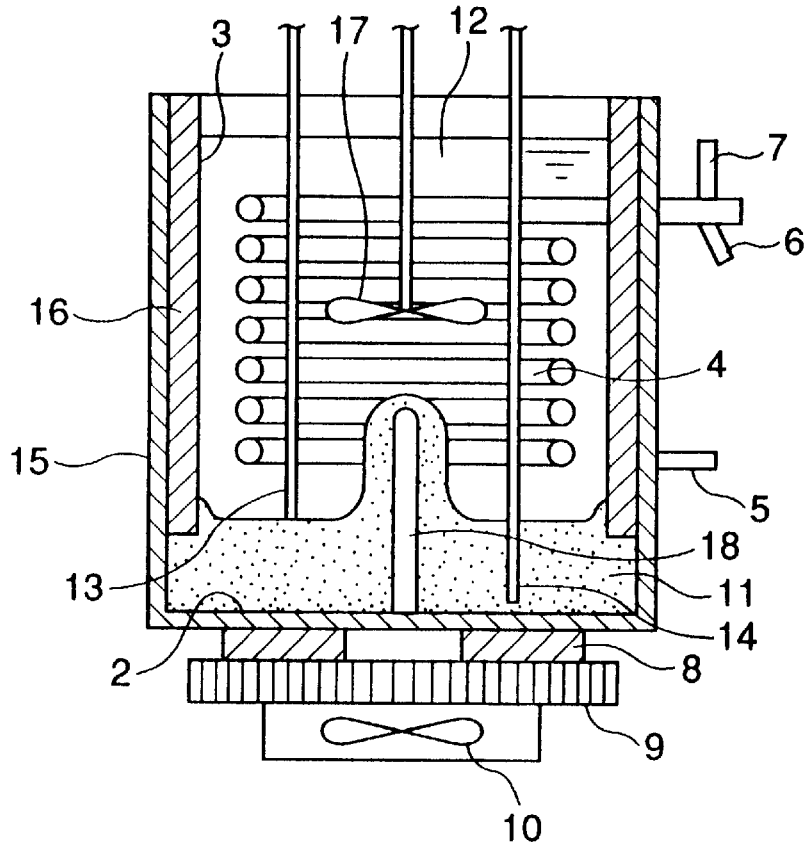
FIG. 9 is a vertical cross-sectional view of yet another embodiment of this invention.

FIG. 7 shows yet another embodiment of this invention that has a sensor 14 disposed near an electronic cooling element in the bottom. FIGS. 8 to 11 show other embodiments that will be described later. FIG. 8 shows an embodiment that has electronic cooling elements 8 on two of the side walls of a rectangular parallelepiped tank 1. Two cooling zones 2 are formed by the same side walls and part of the remaining two side walls on both sides of a beverage duct 4. FIG. 9 shows an embodiment in which an electronic cooling element 8 is disposed under the bottom of a cylindrical tank 1, with the bottom and part of the side of the tank 1 forming a cooling zone 2.

Figure 10:
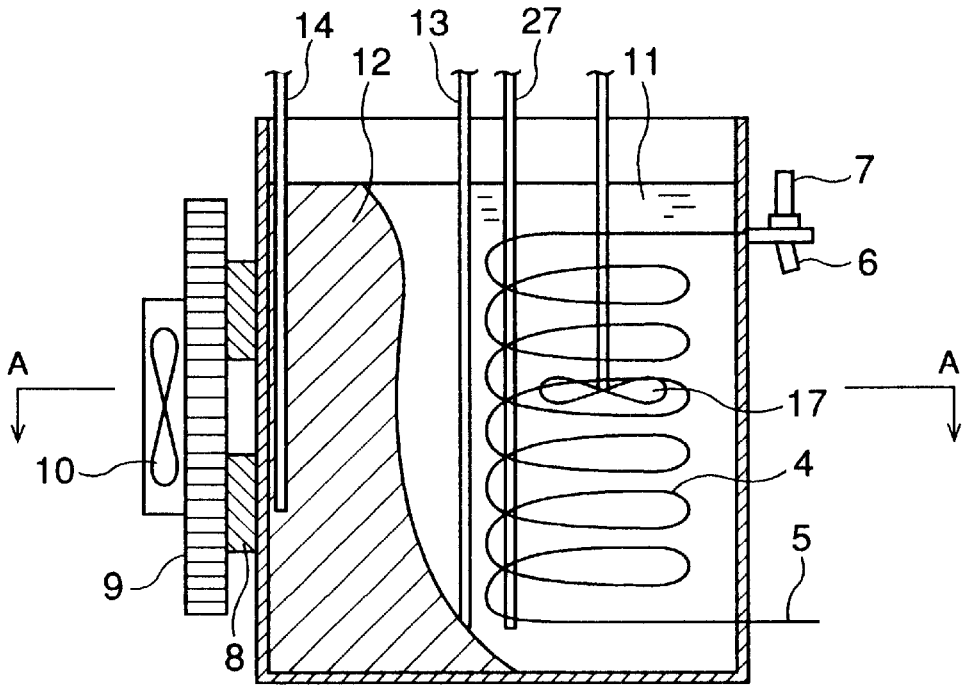
FIG. 10 is a vertical cross-sectional view of still another embodiment of this invention.
Figure 11:
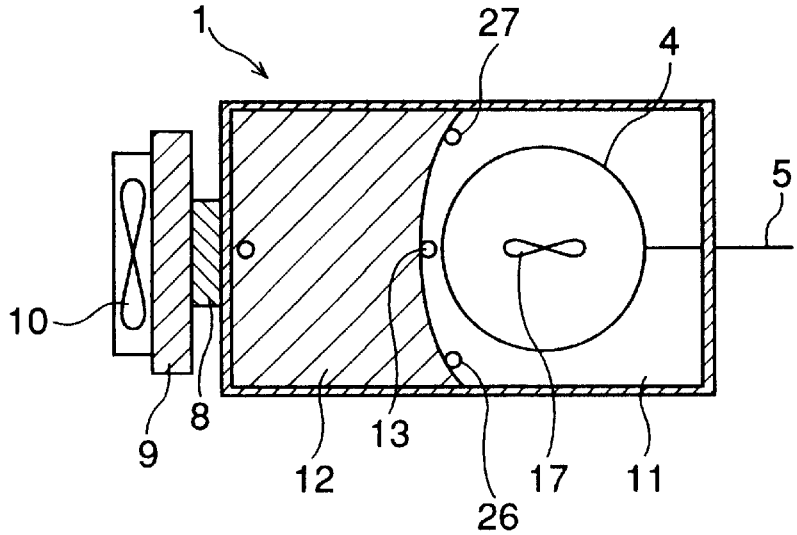
FIG. 11 is a horizontal cross-sectional view of the same embodiment seen in the direction of the arrow A—A in FIG. 10.
Figure 12:
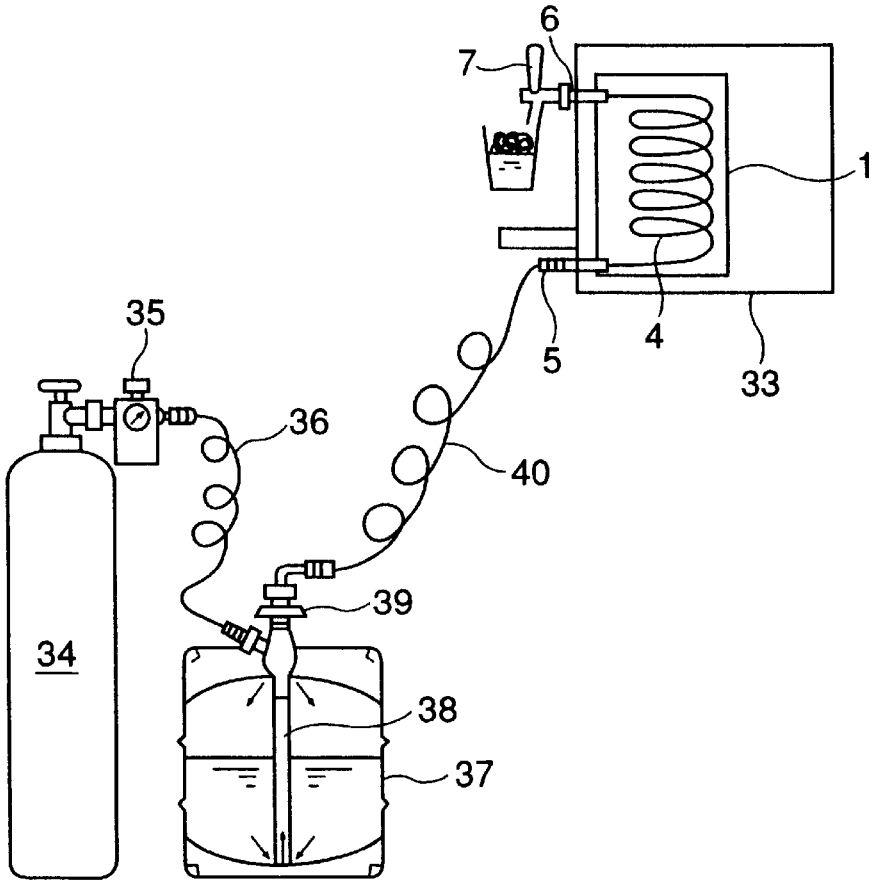
FIG.12 PRIOR ART
FIG. 12 is a schematic view illustrating a conventional instantaneously cooling beverage server.
Figure 13:
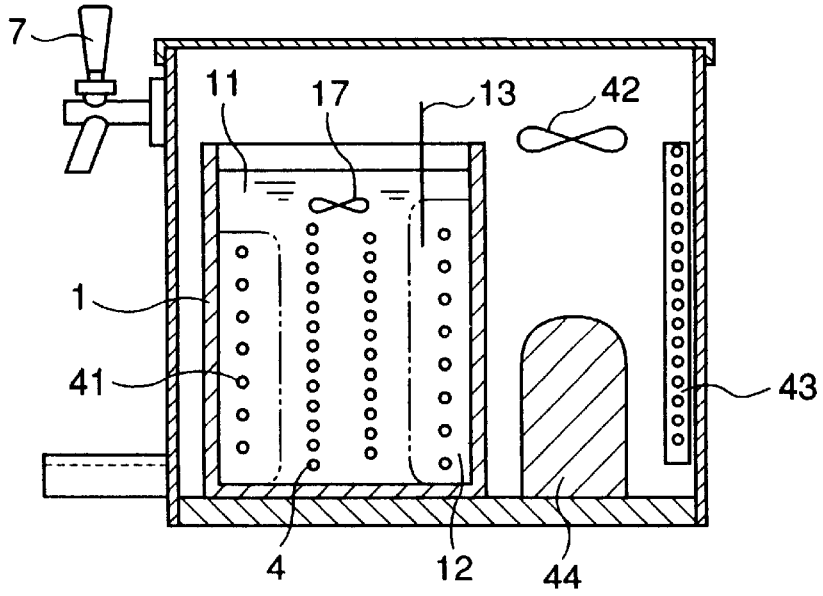
FIG.13 PRIOR ART
FIG. 13 is a vertical cross-sectional view of a conventional instantaneously cooling beverage server.
Figure 14:
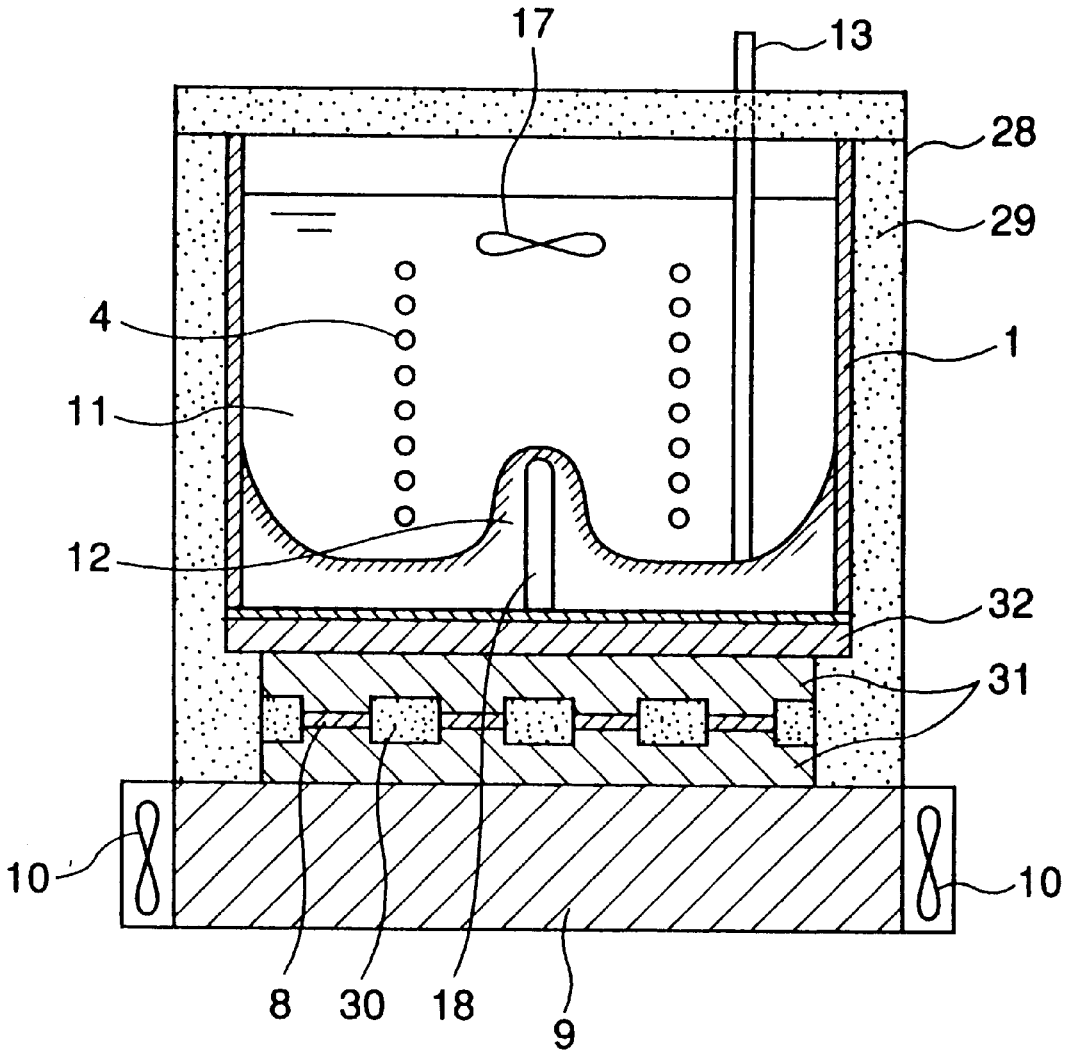
FIG.14 PRIOR ART
FIG. 14 is a vertical cross-sectional view of another conventional instantaneously cooling beverage server.
Figure 15:
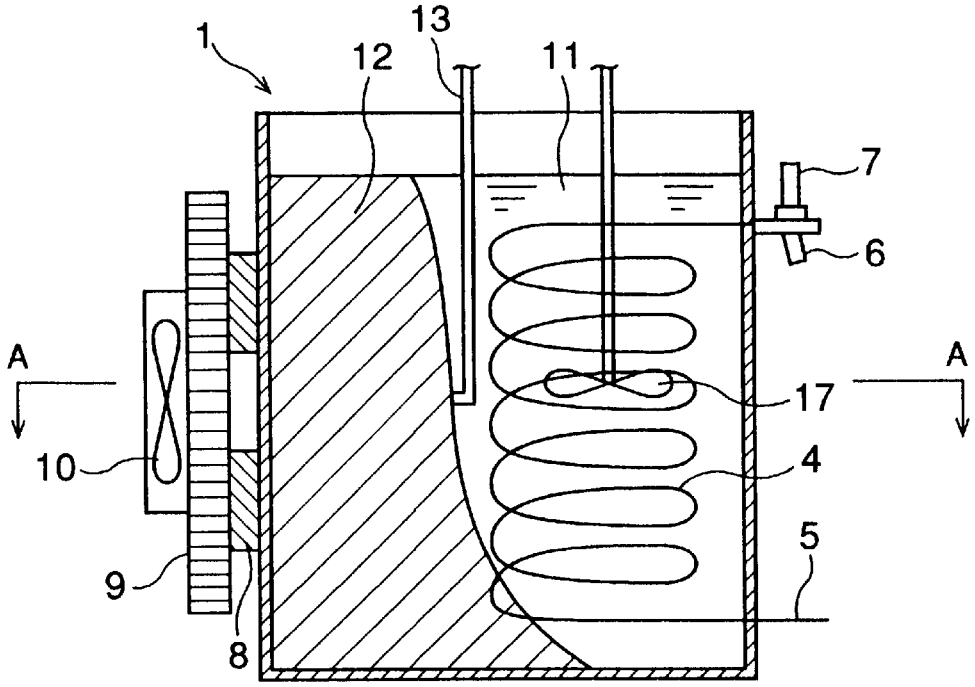
FIG.15 PRIOR ART
FIG. 15 is a vertical cross-sectional view of yet another conventional instantaneously cooling beverage server.
Figure 16:
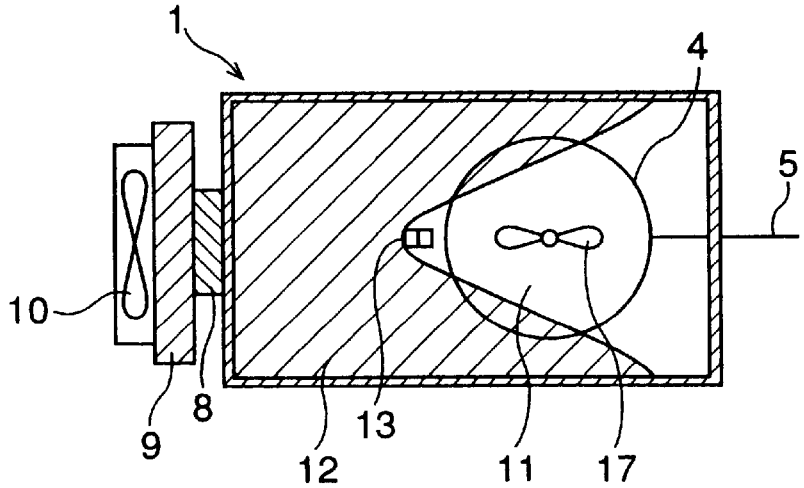
FIG.16 PRIOR ART
FIG. 16 is a horizontal cross-sectional view of the same conventional instantaneously cooling beverage server seen in the direction of the arrow A—A in FIG. 15.

FIGS. 10 and 11 show an embodiment whose tank 1 has no controlled cooling zone to control the forming of ice. In this embodiment, multiple sensors 13 are provided to avoid the growth of ice 12 into a coiled beverage duct 4 that might occur near the bottom of the tank 1 if only one sensor 13 is provided near the beverage duct 4.

Heat from the cooling surface side may melt the ice formed in the tank if cooling is discontinued or moderated. Even on such occasions, advance of the melting can be prevented by means of a sensor 14 that is provided near the cooling surface to detect the melting and immediately resume the cooling operation.

Next, a controlling method according to this invention will be described. As illustrated in FIGS. 1 and 2, the sensor 13 is provided near the beverage duct 4 to detect the change of water to ice and vice versa. When ice is formed in a desired area as illustrated, power supply to the cooling element 8 is cut or reduced to stop or moderate cooling. In a moderated condition, the beverage server according to this invention is almost non-operative or operating at a very low rate that is only enough to maintain the desired quantity of ice. Specifically, this condition can be obtained by supplying power to only some of the cooling elements 8 provided. Preferably, more efficient operation can be achieved if the cooling capacity is controlled to a level high enough to maintain the desired quantity of ice by taking into account the ambient temperature, the temperature of the beverage before being cooled, the frequency of services and other conditions.

When the sensor 13 detects the melting of ice, power supply to the cooling element 8 is increased to resume full cooling so that the melted water freezes again. This switching is accomplished by means of the controller 20 that controls the power supplied from the cooling element power supply 22 to the electronic cooling element 8 using the information input from the sensor 13 and a preset control logic. Power supplies from the fan drive power supply 21 to the fan 10 and from the stirrer drive power supply 23 to the stirrer 17 can be controlled, too. Control conditions can be adjusted as well by measuring the temperature of the water 11.

FIGS. 5 and 6 show another controlling method according to this invention. Sensors 13 and 14 to detect the change of water to ice and vice versa are provided near the beverage duct 4 and near the inner wall of a portion of the tank 1 where an electronic cooling element 8 is provided, respectively. When ice has been formed in a desired area as illustrated, cooling is stopped or moderated by cutting off or reducing power supply to the electronic cooling element 8. In a moderated condition, the beverage server according to this invention is almost non-operative or operating at a very low rate that is only enough to maintain the desired quantity of ice. Specifically, this condition can be obtained by supplying power to only some of the cooling elements 8 provided. Preferably, more efficient operation can be achieved if the cooling capacity is controlled to a level high enough to maintain the desired quantity of ice by taking into account the ambient temperature, the temperature of the beverage before being cooled, the frequency of services and other conditions.

When one or both of the sensor 13 and sensor 14 detects the melting of ice, power supply to the cooling element 8 is increased to resume full cooling so that the melted water freezes again. This switching is accomplished by means of the controller 20 that controls the power supplied from the cooling element power supply 22 to the electronic cooling element 8 using the information input from the sensors 13 and 14 and a preset control logic. Power supplies from the fan drive power supply 21 to the fan 10 and from the stirrer drive power supply 23 to the stirrer 17 can be controlled, too. Control conditions can be adjusted as well by measuring the temperature of the water 11 by a thermometer 19.

Heat from the cooling surface side may melt the ice formed in the tank if cooling is discontinued or moderated. Even on such occasions, advance of the melting can be prevented by means of a sensor 14 that is provided near the cooling surface to detect the melting and immediately resume the cooling operation. Because of heat transfer, the temperature at the cooling surface is lowest when cooling is done and the formation of ice starts at the cooling surface. Thus, ice does not grow beyond the sensor 13 near the beverage duct 4 even when the cooling operation is resumed after interruption caused by the melting of ice.

Even during the night or other times when service is discontinued and cooling is stopped or moderated, advance of melting due to the incoming heat from the cooling surface side can be prevented by a simple mechanism. Also, no trouble due to cooling capacity shortage occurs when service is resumed. Efficient, energy-saving system control can be achieved by controlling the cooling rate continuously or stepwise by taking into account the ambient temperature, the temperature of the beverage before being cooled, the frequency of services and other conditions.

EXAMPLES

A beer server of the type illustrated in FIGS. 1 and 2 was manufactured on a commercial scale. Eight electronic cooling elements 8 were used. The cooling zone 2 and the controlled cooling zone 3 of the tank 1 were made of stainless steel and polyvinyl chloride. The tank 1 was covered with an insulating material. The server measured 230 mm wide, 410 mm deep and 560 mm high.

The server was capable of making 3.0 kg or more of ice in 15 hours during the night at an ambient temperature of 25° C. or below. Ice was made near but not in contact with the coiled beverage duct 4, as illustrated in FIGS. 1 and 2. The server served 10 liters per day of beer at a speed of 50 milliliters per second at a temperature of 2° C. to 8° C.

Other types of serves illustrated in FIGS. 8 to 11 were also manufactured.

The server shown in FIG. 8 had electronic cooling elements 8 on two side walls of the tank 1. The same two side walls and part of the other two side walls form cooling zones 2 on both sides of the beverage duct 4. Sensors 14 are provided near the two cooling surfaces, whereas sensors 13 are provided on the cooling surface sides near the beverage duct 4. The metal sheet 15 constituting the cooling zone 2 and the plastic sheet 16 constituting the controlled cooling zone 3 are joined together with bolts and nuts 25. Because ice is formed on both sides of the beverage duct 4, this server has a high cooling capacity and a large beverage serving capacity. Two different kinds of beverages can be served if the beverage duct 4 is double-coiled.

The server shown in FIG. 9 has an electronic cooling element 8 under the bottom of the tank 1. The bottom and part of the side wall of the tank forms the cooling zone 2. Sensors 13 and 14 are provided near the beverage duct 4 and near the cooling surface. The sensor 14 may be provided near the electronic cooling element 8 on the left side.

The heat-exchange rod 18 extends from the cooling zone at the bottom of the tank to the inside of the beverage duct 4. The heat-exchange rod 18 is made of the same material having a high thermal conductivity as that forms the cooling zone 2. The plastic sheet 16 forming the controlled cooling zone 3 is fitted in the side wall of the tank 1 made of the metal sheet 15, as illustrated. With ice 12 formed below the coiled beverage duct 4 and inside the lower part thereof, this server has a high cooling capacity and a large beverage serving capacity.

In the servers illustrated in FIGS. 8 and 9 and in FIGS. 5 to 7, the sensor 13 is approximately 10 mm away from the beverage duct 4 and approximately at the middle of the height of the beverage duct 4 in the tank. The sensor 14 is in a position where the electronic cooling element 8 is fitted at approximately 5 mm away from the cooling surface. This area is most severely cooled when the cooling element 8 is at work. Sometimes, ice is not formed in other areas. Even so, the quantity of ice formed is adequate for cooling the beverage. Therefore, detection of freezing and melting may be performed where the cooling element 8 is provided.

In the server shown in FIGS. 10 and 11, ice 12 may grow into the coiled beverage duct 4 near the bottom of the tank 1 if only one sensor 13 is provided near the beverage duct 4. To avoid such a growth of ice, sensors 13 are provided in multiple places. In the server illustrated in FIG. 11, three sensors are provided. Two sensors 26 and 27 are near the two side walls of the tank and one sensor 13 is substantially at the middle. These sensors control the growth of ice substantially as illustrated, and the resulting effect is similar to that obtained from the server illustrated in FIGS. 5 to 8.

With the servers illustrated in FIGS. 7 to 11, advance of melting from the cooling surface was prevented by controlling the cooling device by the controller 20 based on the information from the sensors 13 and 14, as with the server illustrated in FIG. 5. The servers illustrated in FIGS. 8 to 11 may also have the tank covered with an insulating material and use various kinds of cooling devices described earlier, as with the servers illustrated in FIGS. 5 to 7.

What is claimed is:

1. A beverage server comprising:

a tank containing water serving as a coolant and a coiled beverage duct through which a beverage flows;

a cooling means fitted to a portion of the wall of the tank;

a sensing means to detect the freezing and melting of the coolant; and a controller for maintaining an ice-making region within a desired area by controlling the action of the cooling means based on the information from the sensing means and rapidly cooling and serving a beverage discharged from a storage container, the improvement comprising a cooling zone consisting of a portion of the inner wall of the tank made of a material having a high thermal conductivity that is situated in and around the place where the cooling means is fitted, a controlled cooling zone consisting of a portion of the inner wall of the tank made of a material having a low thermal conductivity that is situated near the beverage duct, and said sensing means provided near said beverage duct.

2. A beverage server comprising:

a tank containing water serving as a coolant and a coiled beverage duct through which a beverage flows;

a cooling means fitted to a portion of the wall of the tank;

a sensing means to detect the freezing and melting of the coolant; and a controller for maintaining an ice-making region within a desired area by controlling the action of the cooling means based on the information from the sensing means and rapidly cooling and serving a beverage discharged from a storage container, the improvement comprising the sensing means provided near the inner wall of the tank where the cooling means is fitted and near the beverage duct.

3. The beverage server according to claim 2, wherein the improvement comprising a cooling zone consisting of a portion of the inner wall of the tank is made of a material having a high thermal conductivity and is situated in and around the place where the cooling means is fitted; and a controlled cooling zone that is situated near the beverage duct consisting of a portion of the inner wall of the tank made of a material having a low thermal conductivity.

4. A met hod for controlling a beverage server comprising:

a tank containing water serving as a coolant and a coiled beverage duct through which a beverage flows;

a cooling means fitted to a portion of the wall of the tank;

a sensing means to detect the freezing and melting of the coolant; and a controller for maintaining an ice-making region within a desired area by controlling the action of the cooling means based on the information from the sensing means and rapidly cooling and serving a beverage discharged from a storage container, the improvement that the cooling zone consisting of a portion of the inner wall of the tank situated in and around the place where the cooling means is fitted is made of a material having a high thermal conductivity and a controlled cooling zone that is situated near the beverage duct consisting of a portion of the inner wall of the tank is made of a material having a low thermal conductivity, and said sensing means provided near said beverage duct, the cooling action of the cooling means is stopped or moderated after the coolant within a desired area has been cooled and frozen by the cooling means and the cooling action of the cooling means is resumed to freeze the coolant again when the sensing means has detected the melting of the coolant.

5. A method for controlling a beverage server comprising:

a tank containing water serving as a coolant and a coiled beverage duct through which a beverage flows;

a cooling means fitted to a portion of the wall of the tank;

a sensing means to detect the freezing and melting of the coolant; and a controller for maintaining an ice-making region within a desired area by controlling the action of the cooling means based on the information from the sensing means and rapidly cooling and serving a beverage discharged from a storage container, the improvement that the sensing means is provided near the inner wall of the tank where the cooling means is fitted and near the beverage duct, the cooling action of the cooling means is stopped or moderated after the coolant within a desired area has been cooled and frozen by the cooling means and the cooling action of the cooling means is resumed to freeze the coolant again when the sensing means has detected the melting of the coolant.

6. A beverage server comprising:

a tank containing water serving as a coolant and a coiled beverage duct through which a beverage flows;

a cooling element fitted to a portion of the wall of the tank;

a sensor coupled to said tank to detect the freezing and melting of the coolant; and a controller for maintaining an ice-making region within a desired area by controlling the action of the cooling element based on the information from the sensor and rapidly cooling and serving a beverage discharged from a storage container, the improvement comprising a cooling zone consisting of a portion of the inner wall of the tank made of a material having a high thermal conductivity that is situated in and around the place where the cooling element is fitted, a controlled cooling zone consisting of a portion of the inner wall of the tank made of a material having a low thermal conductivity that is situated near the beverage duct, and said sensor provided near said beverage duct.

7. A beverage server comprising:

a tank containing water serving as a coolant and a coiled beverage duct through which a beverage flows;

a cooling element fitted to a portion of the wall of the tank;

a sensor coupled to said tank to detect the freezing and melting of the coolant; and a controller for maintaining an ice-making region within a desired area by controlling the action of the cooling means based on the information from the sensing means and rapidly cooling and serving a beverage discharged from a storage container, the improvement comprising the sensor provided near the inner wall of the tank where the cooling element is fitted and near the beverage duct.

8. The beverage server according to claim 7, wherein the improvement comprising a cooling zone consisting of a portion of the inner wall of the tank is made of a material having a high thermal conductivity and is situated in and around the place where the cooling element is fitted; and a controlled cooling zone that is situated near the beverage duct consisting of a portion of the inner wall of the tank made of a material having a low thermal conductivity.

9. A method for controlling a beverage server comprising:

a tank containing water serving as a coolant and a coiled beverage duct through which a beverage flows;

a cooling element fitted to a portion of the wall of the tank;

a sensor coupled to said tank to detect the freezing and melting of the coolant; and a controller for maintaining an ice-making region within a desired area by controlling the action of the cooling element based on the information from the sensor and rapidly cooling and serving a beverage discharged from a storage container, the improvement that the cooling zone consisting of a portion of the inner wall of the tank situated in and around the place where the cooling element is fitted is made of a material having a high thermal conductivity and a controlled cooling zone that is situated near the beverage duct consisting of a portion of the inner wall of the tank is made of a material having a low thermal conductivity, and said sensor provided near said beverage duct, the cooling action of the cooling element is stopped or moderated after the coolant within a desired area has been cooled and frozen by the cooling element and the cooling action of the cooling element is resumed to freeze the coolant again when the sensor has detected the melting of the coolant.

10. A method for controlling a beverage server comprising:

a tank containing water serving as a coolant and a coiled beverage duct through which a beverage flows;

a cooling element fitted to a portion of the wall of the tank;

a sensor coupled to said tank to detect the freezing and melting of the coolant; and a controller for maintaining an ice-making region within a desired area by controlling the action of the cooling element based on the information from the sensor and rapidly cooling and serving a beverage discharged from a storage container, the improvement that the sensor is provided near the inner wall of the tank where the cooling element is fitted and near the beverage duct, the cooling action of the cooling element is stopped or moderated after the coolant within a desired area has been cooled and frozen by the cooling element and the cooling action of the cooling element is resumed to freeze the coolant again when the sensor has detected the melting of the coolant.

* * * * *